US005551656A

United States Patent [19]

De Lozada et al.

[11] Patent Number: 5,551,656

[45] Date of Patent: Sep. 3, 1996

[54] APPARATUS FOR SUPPORTING AND DISPLAYING A DOLL

[76] Inventors: Rudy De Lozada, 777 Arguello Boulevard, San Francisco, Calif. 94118; Waldeman Dreher, 5261 Milton Ranch Rd., Shingle Springs, Calif. 95682

[21] Appl. No.: 326,723

[22] Filed: Oct. 20, 1994

[51] Int. Cl.[6] ..... F16M 11/00

[52] U.S. Cl. ..... 248/176.1; 248/122.1

[58] Field of Search ..... 248/176, 121, 248/122, 346

[56] References Cited

U.S. PATENT DOCUMENTS

| | | | |
|---|---|---|---|
| 1,308,340 | 7/1919 | Deibel et al. . | |
| 1,931,584 | 10/1933 | Luff . | |
| 2,765,136 | 10/1956 | Knapp . | |
| 2,874,267 | 2/1959 | Shipley . | |
| 3,279,736 | 10/1966 | Vogt, IIII | 248/176 X |
| 3,463,437 | 8/1969 | Henderson . | |
| 3,516,632 | 6/1970 | Hall | 248/176 |
| 3,699,712 | 10/1972 | Handler et al. | 248/346 X |
| 4,275,535 | 6/1981 | Stalzer | 52/100 |
| 4,706,915 | 11/1987 | Cindric et al. | 248/122 |
| 4,708,309 | 11/1987 | Walter | 248/118.4 |
| 4,717,110 | 1/1988 | Fohrman | 248/545 |
| 4,943,021 | 7/1990 | Cien et al. | 248/167 |
| 5,209,694 | 5/1993 | Utt, Jr. | 248/346 X |
| 5,326,057 | 7/1994 | Lin | 248/176 X |

*Primary Examiner*—Ramon O. Ramirez
*Attorney, Agent, or Firm*—Thomas R. Lampe

[57] ABSTRACT

Apparatus for supporting and displaying a doll including a base, one or more columns connected to the base, and a plurality of elongated support elements extending from the columns.

17 Claims, 8 Drawing Sheets

Fig. 1A
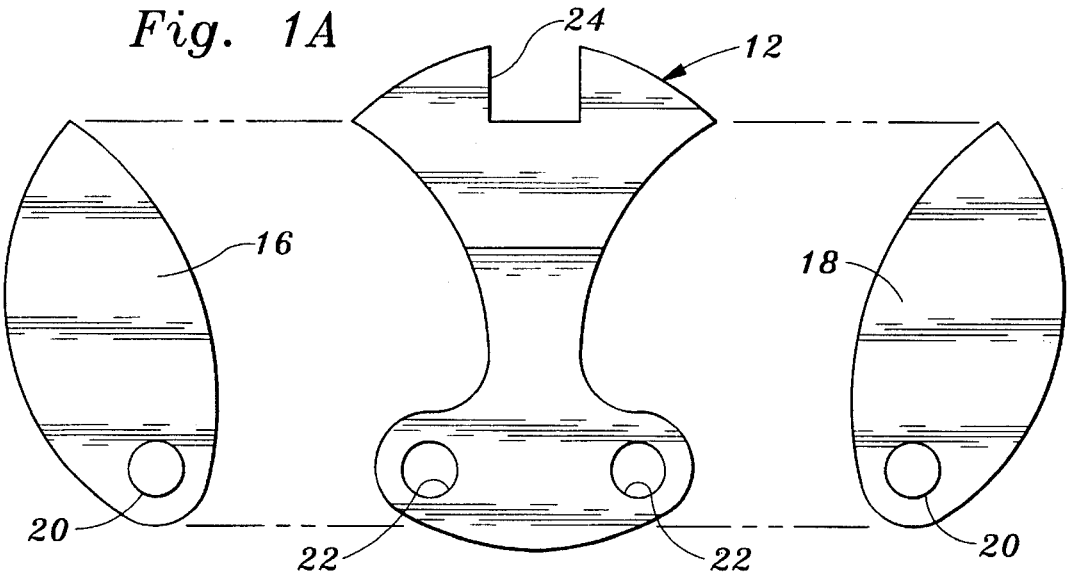
Fig. 1B
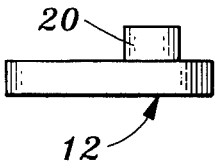
Fig. 1C
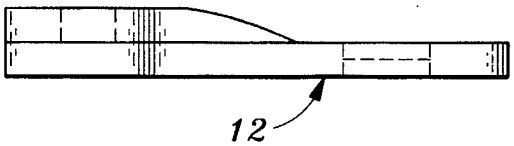
Fig. 1D
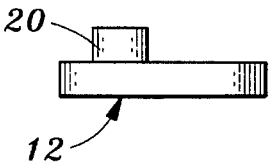
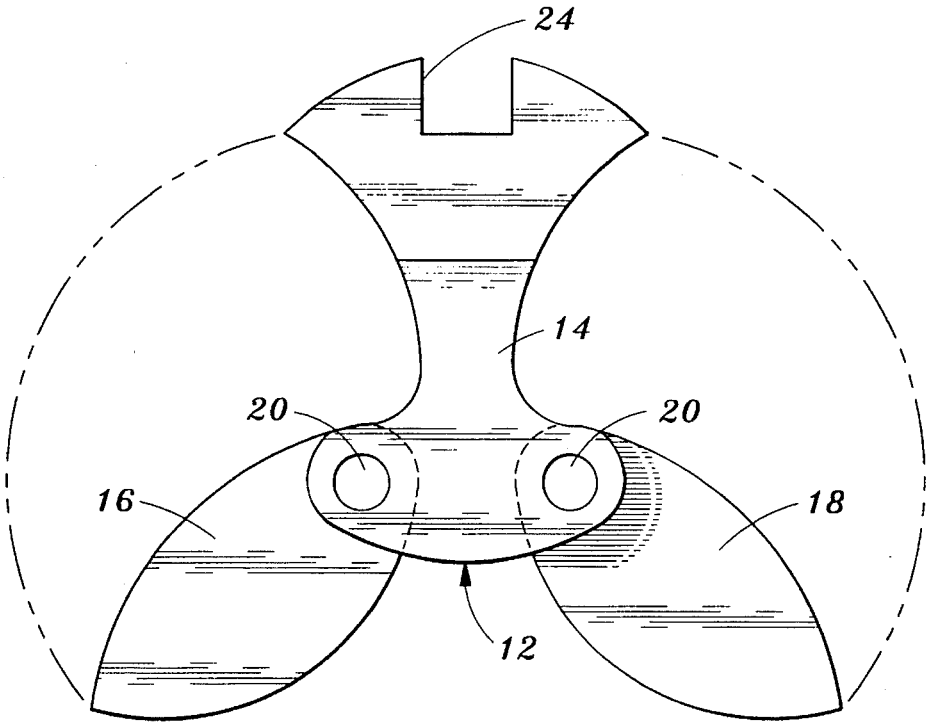
Fig. 2

Fig. 3
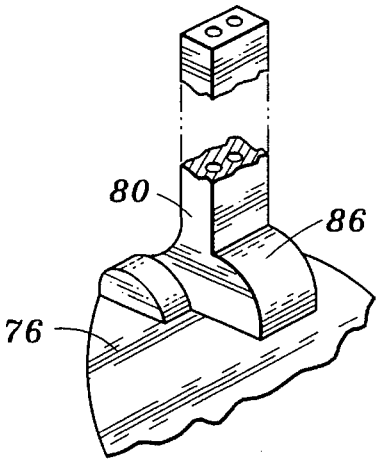
Fig. 3A
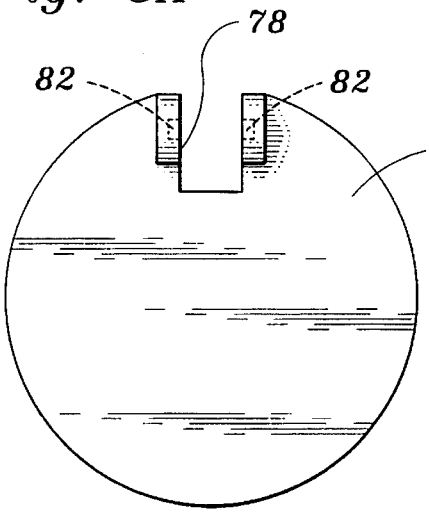
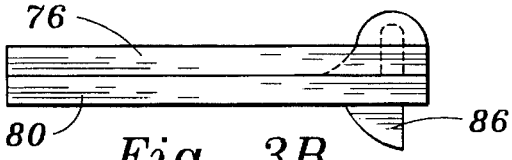
Fig. 3B
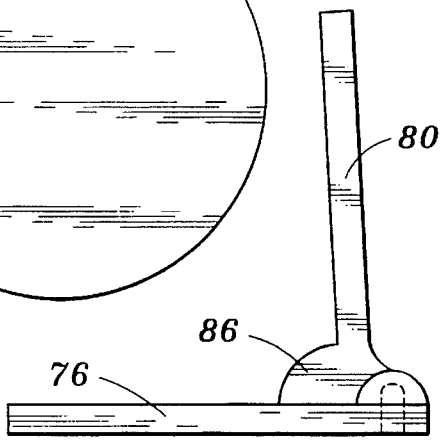
Fig. 3C
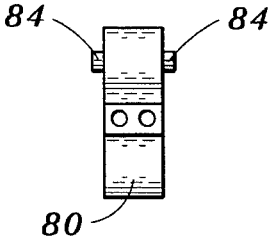
Fig. 3D
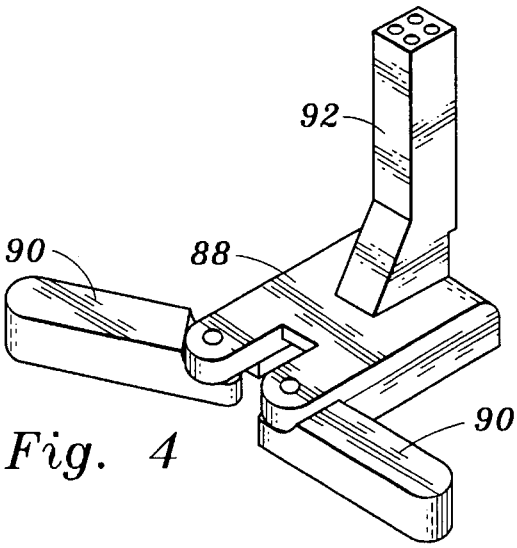
Fig. 4
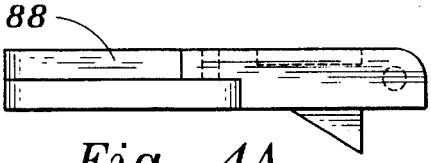
Fig. 4A
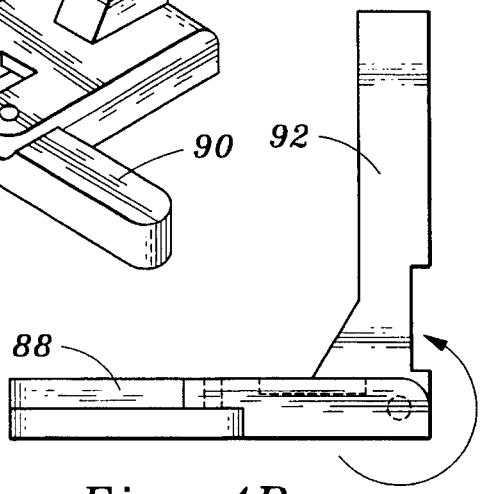
Fig. 4B Fig. 9
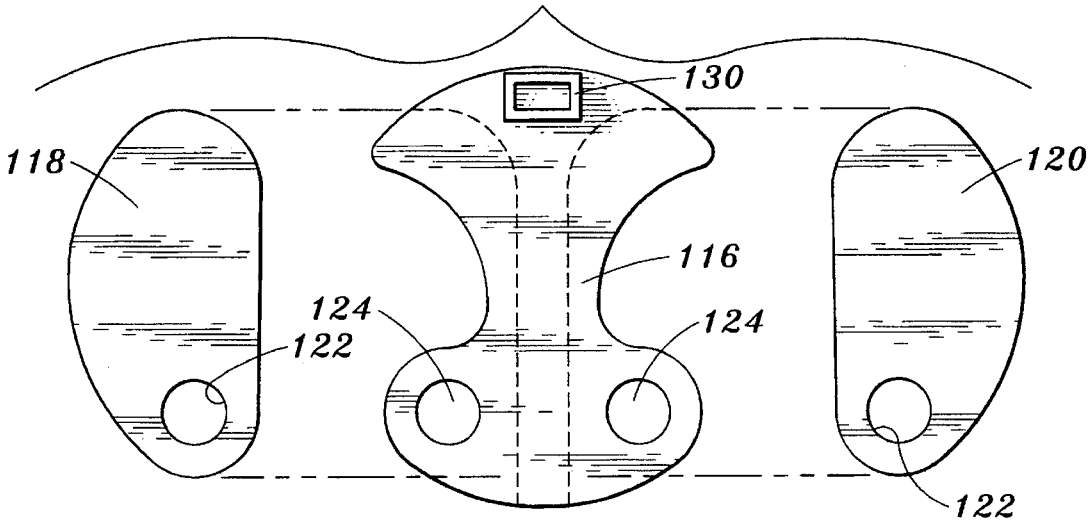
Fig. 10
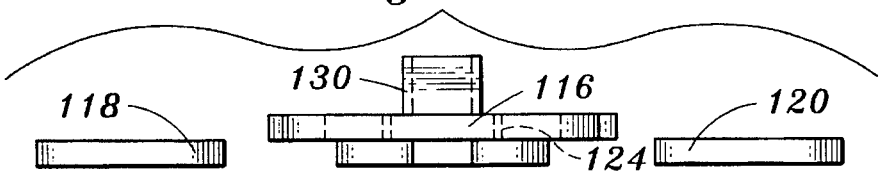
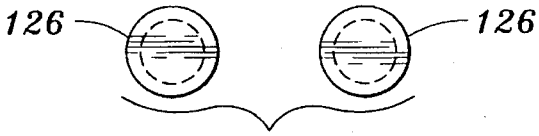
Fig. 11
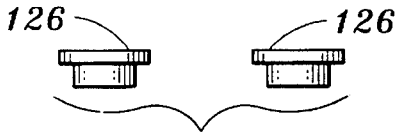
Fig. 12
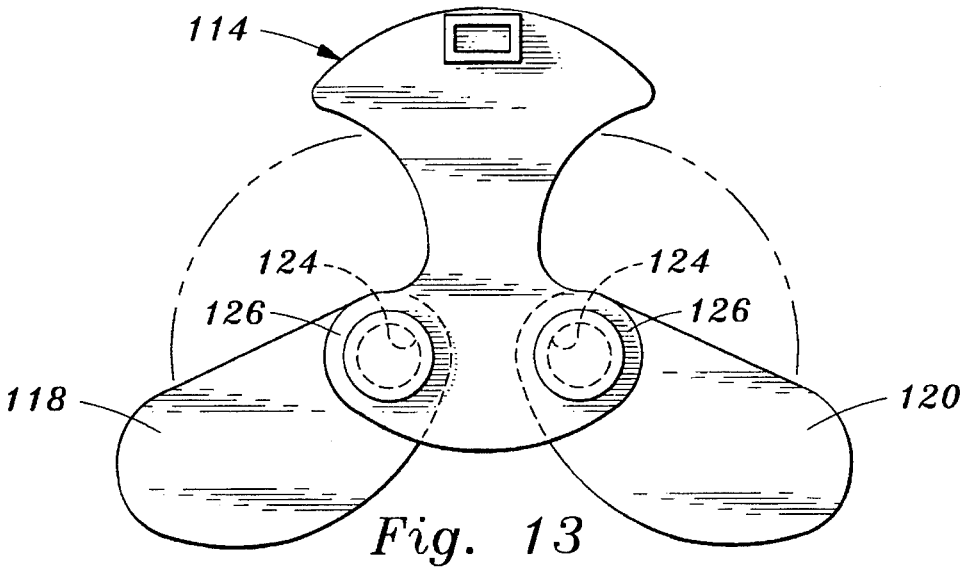
Fig. 13

Fig. 16
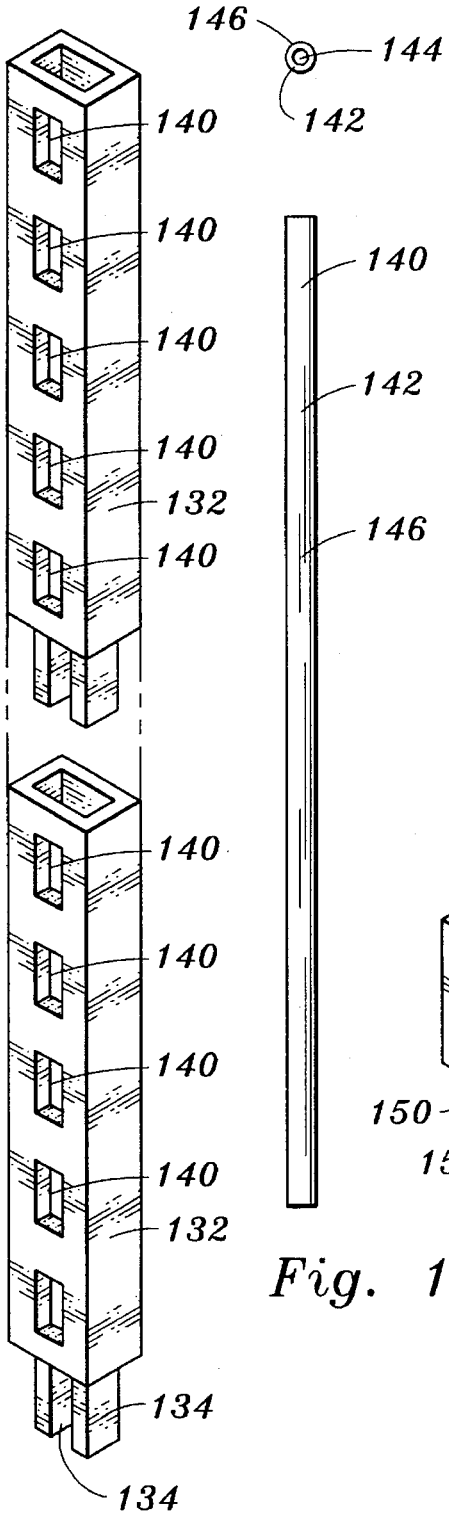
Fig. 15
Fig. 17
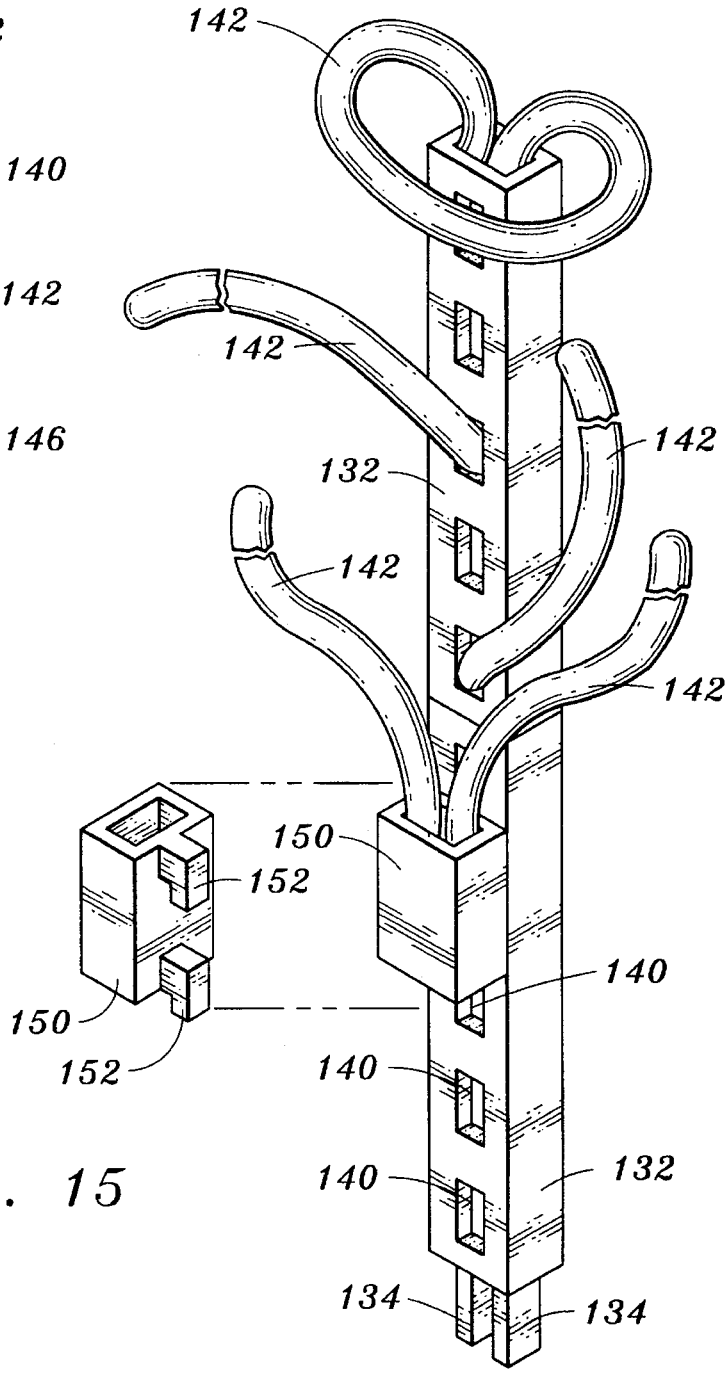
Fig. 14

APPARATUS FOR SUPPORTING AND DISPLAYING A DOLL

TECHNICAL FIELD

This invention relates to apparatus for supporting and displaying objects. The apparatus has particular application to the support and display of a doll. The apparatus may be utilized to support dolls of many different sizes and configurations and display the dolls in a variety of positions and postures.

BACKGROUND ART

Stands for supporting and displaying dolls are known in the prior art. Prior art approaches are generally characterized by their inability to display dolls in a variety of postures. Furthermore, many such stands are limited in other respects, such as their inability to accommodate a wide variety of shapes and sizes of dolls.

U.S. Pat. No. 4,706,915, issued Nov. 17, 1987, discloses a display stand for supporting a doll which supports a doll on a bracket extending from a vertical bar, the bracket being positioned between the legs of the doll. A strap is deployed about the upper portion of the doll to maintain the upper porion of the doll in position. While elements of the apparatus of U.S. Pat. No. 4,706,915 can be tilted, there is no provision for changing the posture of the doll other than that which results from tilting of the doll body with such mechanism. In other words, a doll supported by the stand of U.S. Pat. No. 4,706,915 has a generally actionless, passive appearance.

The following patents disclose supports and display devices of even less pertinence to applicant's invention: U.S. Pat. No. 4,706,915, issued Nov. 17, 1987, U.S. Pat. No. 4,717,110, issued Jan. 5, 1988, U.S. Pat. No. 2,765,136, issued Oct. 2, 1956, U.S. Pat. No. 1,308,340, issued Jul. 1, 1919, U.S. Pat. No. 2,874,267, issued Feb. 17, 1959, U.S. Pat. No. 4,275,535, issued Jun. 30, 1981, U.S. Pat. No. 4,708,309, issued Nov. 24, 1987, U.S. Pat. No. 4,943,021, issued Jul. 24, 1990, U.S. Pat. No. 1,931,584, issued Oct. 24, 1933, and U.S. Pat. No. 3,463,437, issued Aug. 26, 1969. The various arrangements shown in these patents are generally inappropriate for displaying dolls.

DISCLOSURE OF INVENTION

The present invention relates to apparatus for supporting and displaying a doll. The structural elements of the invention are cooperable to adapt the apparatus for use with a wide variety of doll configurations and sizes. Furthermore, the apparatus may be utilized to pose the doll in a variety of postures. The invention is also characterized by its relative simplicity and low cost.

The apparatus includes base means for positioning on a support surface. Column means is provided for connecting to the base means whereby the column means extends upwardly from the base means and is stabilized relative to the support surface by the base means. The column means has a column means distal end and defines at least one recess at the column means distal end.

A plurality of elongated support elements are selectively positionable in the at least one recess. Each elongated support element has an attachment end and an outer end spaced from the attachment end.

Doll engagement means is connected to the elongated support elements at the outer ends of the elongated support elements for engaging a doll at spaced locations on the doll to support and display the doll when the attachment ends of the elongated support elements are positioned in the at least one recess.

The doll engagement means comprises at least one arm member connected to each of the elongated support elements at the outer end thereof. Each arm member projects laterally from the elongated support element connected thereto.

Other features, advantages, and objects of the present invention will become apparent with reference to the following description and accompanying drawings.

BRIEF DESCRIPTION OF DRAWINGS

FIG. 1A is an exploded view of the base of the apparatus of FIG. 1;

FIGS. 1B, 1C, and 1D are, respectively, side views of elements of the base of FIG. 1;

FIG. 2 is a plan view of the base of FIG. 1 in assembled condition;

FIG. 3 is a partial, perspective view of an alternative form of base;

FIG. 3A is a plan view of an element of the base of

FIG. 3;

FIG. 3B is a side view illustrating the base of FIG. 3 in collapsed condition;

FIG. 3C is a side view of the base of FIG. 3 showing the base in an erected condition;

FIG. 3D is a plan view of another element of the base of FIG. 3;

FIG. 4 is a perspective view of elements of an alternative embodiment of the present invention including a base and column;

FIG. 4A is a side view of the apparatus of FIG. 4 in collapsed condition;

FIG. 4B is a side view of the apparatus of FIG. 4 with the column thereof erected;

FIG. 9 is a plan view illustrating separated base components of the FIG. 8 embodiment;

FIG. 10 is an elevational view illustrating separated base components of the FIG. 8 embodiment;

FIGS. 11 and 12 are, respectively, top and elevational views of connector members employed in the FIG. 8 embodiment;

FIG. 13 is a plan view showing the base components of the FIG. 8 embodiment in assembled condition; FIG. 14 is a perspective view showing two disassembled column elements of the FIG. 8 embodiment;

FIGS. 15 and 16 are, respectively, elevational and top views of an elongated support member employed in the FIG. 8 embodiment; and FIG. 17 illustrates assembled column members, elongated support members and an elongated support member holder employed in the FIG. 8 embodiment.

MODES FOR CARRYING OUT THE INVENTION

Figure 1:
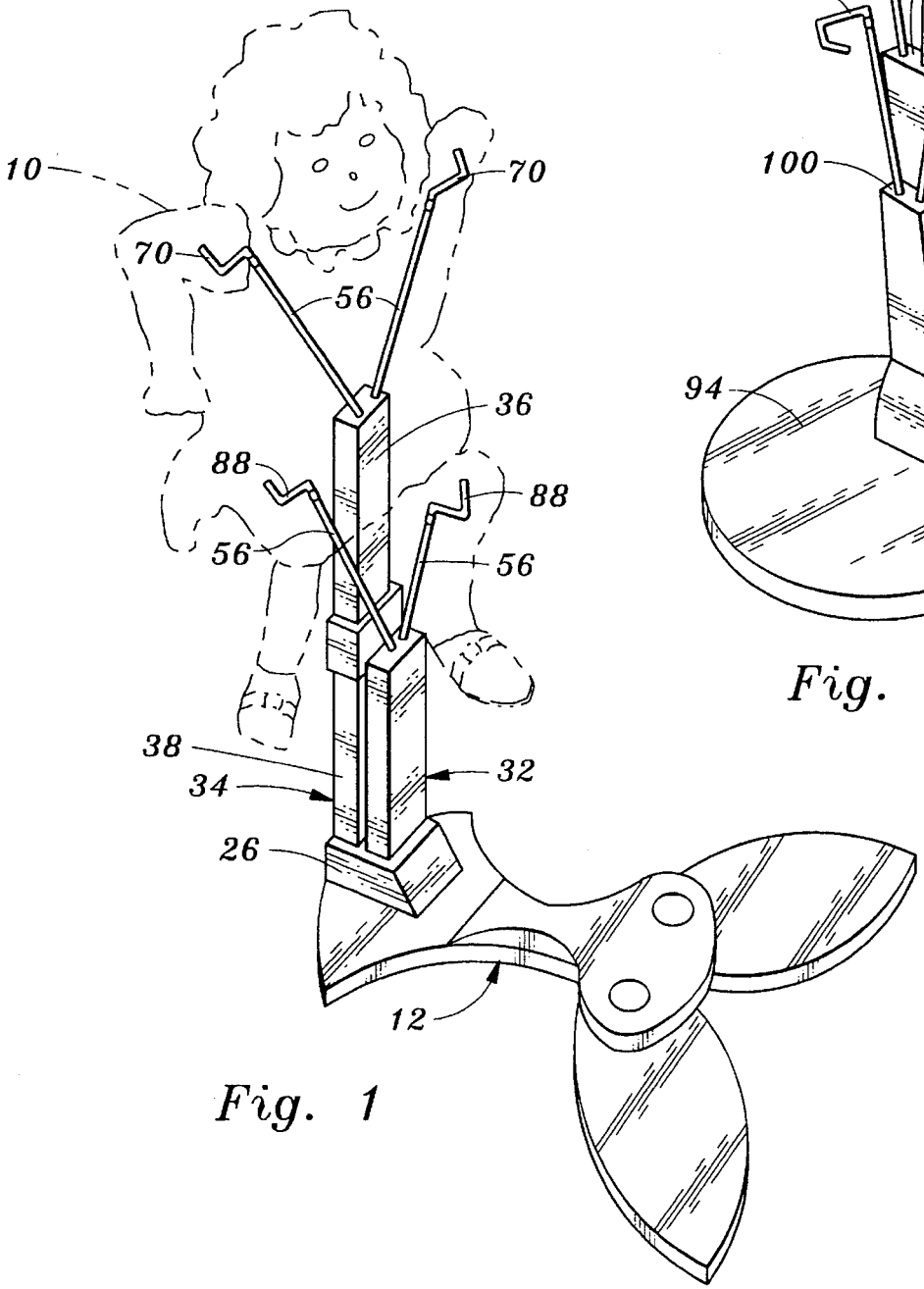
FIG. 1 is a perspective view of a preferred form of apparatus constructed in accordance with the teachings of the present invention supporting a doll shown in phantom.

Referring to FIGS. 1, 1A–1D, 2, 5, 5A–5D, 6 and 6A–6F, a preferred embodiment of the invention is illustrated. The apparatus is for the purpose of displaying a doll, a representative example of which is shown in FIG. 1 in phantom and designated by reference numeral 10. The apparatus is adaptable for use with a wide variety of doll configurations and sizes and may be utilized to pose the doll in a variety of postures. The posture of FIG. 1 is but one example.

The apparatus includes a base 12 for positioning on a support surface. Base 12 includes a central base member 14 and two supplemental base members 16, 18. At an end thereof each of the supplemental base members 16, 18 has an upstanding pivot post 20 which is positionable in correspondingly shaped apertures 22 defined by central base member 14. The supplemental base members 16, 18 may be pivoted relative to the central base member to form a generally Y-shaped configuration as shown in FIG. 2. Alternatively, the supplemental base members 16, 18 may be rotated so that sides thereof are in engagement with the central base member and the combined base members 14, 16, 18 define a generally circular-shaped configuration as viewed from either the top or bottom. As with the other components of the apparatus to be described in detail below, base members 14, 16, 18 may be formed of any suitable material such as molded plastic.

It will be appreciated that the base, when configured generally in a Y-shape as shown in FIG. 2, has greater stability against tipping than when the base members are brought together.

A notch 24 is defined by base 12. The notch 24 is for receiving a base connector 26. Base connector 26 can be slid into and out of position with respect to central base member 14 at the notch 24. Base connector 26 has a slot 28 which receives the base to maintain the base connector and base in an assembled condition.

Base connector 26 also defines two openings 30 at the top thereof. These openings or recesses 30 receive therein columns 32, 34 which simply slip into position in the recesses when the apparatus is being assembled.

Column 34 is illustrated as being of multi-component construction, including two column elements 36, 38 interconnected by a column connector 40. Column connector 40 has a recess 42 for receiving column element 36 and a recess 34 for receiving column element 38. It will be appreciated that additional column elements and column connectors may be employed to extend the length of column 34.

Column 32, on the other hand, is wholly comprised of a single column element 46. Of course, column 32 could, if desired, be comprised of more than one column element and interconnected column connector or connectors to extend the length thereof.

At their upper distal ends the columns 32, 34 define spaced recesses 50, 52. The recesses are elongated and preferably extend through the entire length of the column elements. The recesses each have a circular cross-sectional configuration except where a rib 54 projects into the interior thereof.

Each of the recesses 50, 52 can receive therein an elongated support element in the form of a rod or rod-like member 56. Preferably, each of the elongated support elements has a degree of flexibility. When assembling the apparatus the lower end of an elongated support element 56 is positioned in one of the recesses 50, 52. Flexing of the portion of elongated support element above the recess will serve to lock the elongated support element against sliding movement relative to its associated column element. Thus, the elongated support elements can be locked into position relative to the column elements at any desired location on the elongated support elements to vary the length of the projecting elongated support elements.

Figure 5:
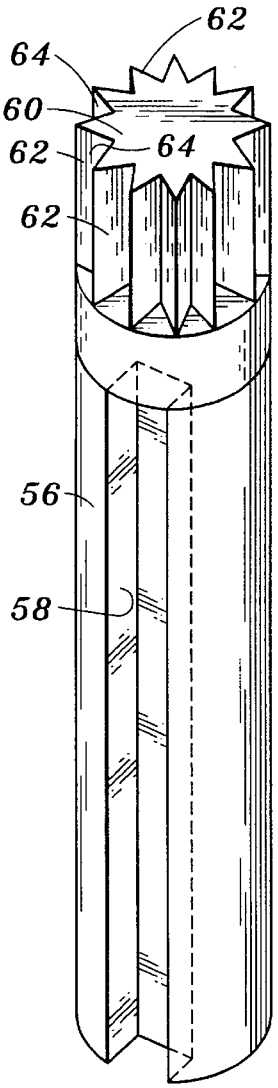
FIG. 5 is a greatly enlarged perspective view of a support element incorporated in the present invention.
Figure 5A:
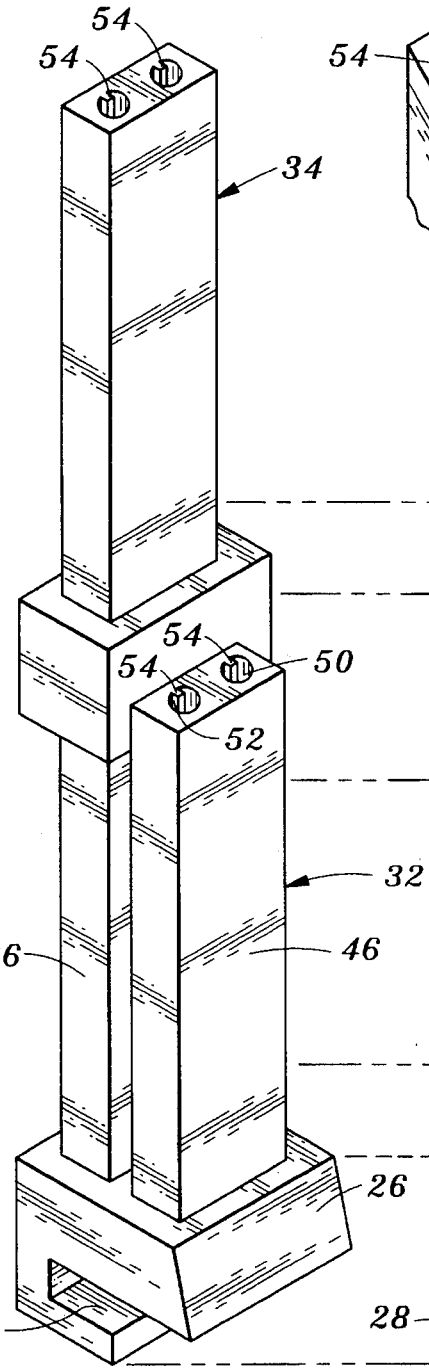
FIG. 5A is an enlarged perspective view of columns and related connectors employed in the apparatus of FIG. 1.
Figure 5B:
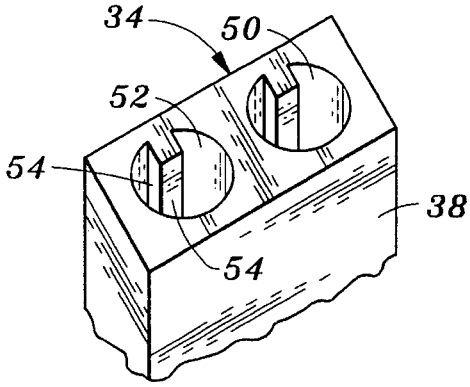
FIG. 5B is an enlarged perspective view of a top portion of the column of FIG. 5A.
Figure 5C:
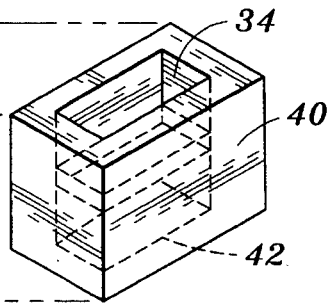
FIG. 5C is an enlarged perspective view of a column connector employed in the arrangement of FIG. 5A.
Figure 5D:
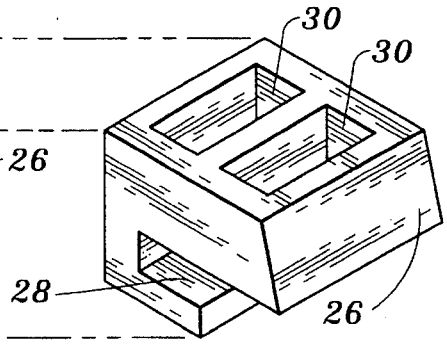
FIG. 5D is an enlarged perspective view of a base connector utilized to connect the column arrangement of FIG. 5A to a base.
Figure 6:
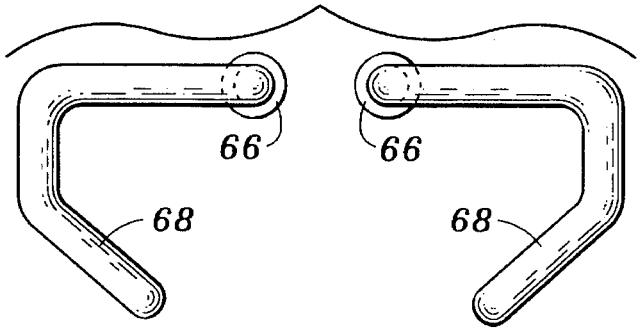
FIG. 6 is a top view of two doll-engagement arm members employed in the apparatus of FIG. 1.
Figure 6A:
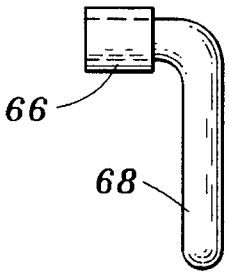
FIG. 6A is a side view of an arm member.
Figure 6B:
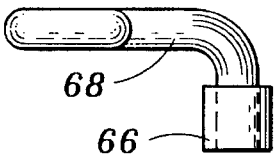
FIG. 6B is a front view of one of the arm members of FIG. 6.
Figure 6C:
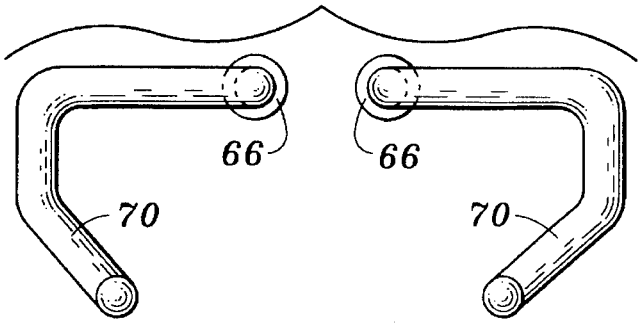
FIG. 6C is a plan view of an alternative form of arm member.
Figure 6D:
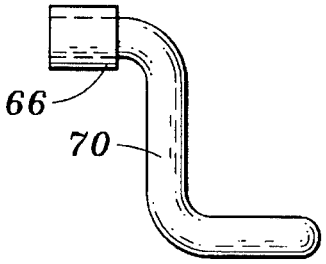
FIG. 6D is a side view of one of the arms of the FIG. 6C embodiment.
Figure 6E:
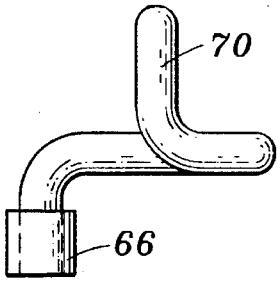
FIG. 6E is a front view of one of the arms of FIG. 6C.
Figure 6F:
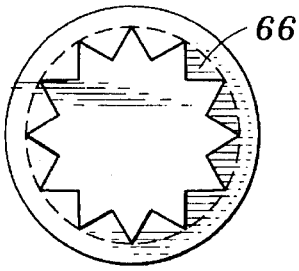
FIG. 6F is an enlarged bottom view of the socket portion of arm member 6E.
Figure 6G:
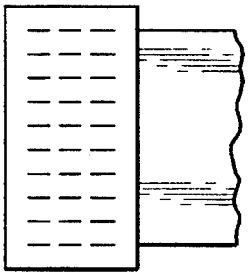
FIG. 6G is a side view of the socket portion shown in FIG. 6D and a segment of the arm member connected thereto.

FIG. 5 is a greatly enlarged depiction of the upper end of one of the elongated support elements 56. It will be seen that an elongated groove 58 extends along most of the length of the elongated support element. Groove 58 receives therein a rib 54 when the elongated support element is inserted into a recess 50, 52. This will serve to prevent rotation of the elongated support element relative to its associated column.

The top or upper end of each elongated support element is notched to provide a projection 60 having a multi-pointed, star-like, cross-sectional configuration. That is, projection 60 has a plurality of alternating pointed ridges 62 and indents 64.

The projections 60 are for positioning in a socket 66 of an arm member employed to engage the doll 10 and maintain the doll at the desired attitude and placement.

The drawings illustrate two forms or configurations of arm members, i.e. arm members 68 and arm members 70. Each of the arm members has a distal end remote from its socket 66. The user of the apparatus of the present invention can use either or both of the arm member configurations since the arm members are readily removable from their respective elongated support elements and replaceable. In the arrangement illustrated in FIG. 1, one type of arm member is employed with column 32 and another with column 34.

The arm members will normally be of a right-hand and left-hand construction with the arm members being disposed in pairs so that they are spaced from one another and curved to define a gap therebetween for accommodating a portion of a doll supported and displayed by the apparatus. Each arm member projects laterally from the elongated support element to which it is connected. The socket 66 has an interior configuration which corresponds to the cross-sectional configuration of projection 60. It will thus be readily apparent that the projection and socket cooperate when connected together to prevent relative rotation between the associated elongated support element and arm member.

FIGS. 3 and 3A–3D disclose another embodiment of the invention. In this particular embodiment the base 76 is solid and unitary. Base 76 has a notch 78 formed therein which receives a column 80 which is pivotally movable relative to the base 76 between the position shown in FIG. 3B and the position shown in FIG. 3C. Relative rotational movement is allowed by sockets 82 formed in the base which receive stub shafts 84 at one end of column 80. A projection 86 halts rotational movement between the column and the base to maintain the column in an erect condition.

FIGS. 4, 4A and 4B represent yet another alternate configuration which may be utilized in the construction of the base and column. More particularly, the base 88 has a central base member to which are pivotally mounted supplemental base members 90 in the form of elongated arms. Rotation of the arms relative to the central base member allows for change of base configuration.

The FIG. 4, 4A and 4B embodiment also includes a column 92 which is pivotally connected to the central base member and may be moved from the collapsed condition shown in FIG. 4A to the erect condition shown in FIG. 4B.

Figure 7:
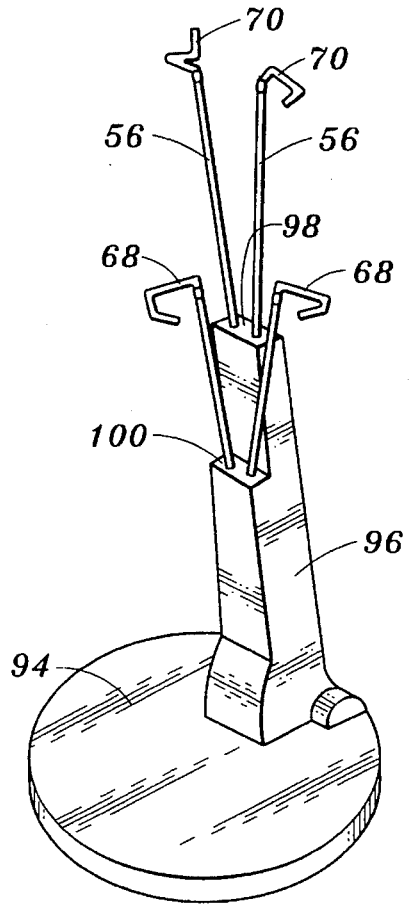
FIG. 7 is a completely assembled alternative form of apparatus constructed in accordance with the teachings of the present invention.

FIG. 7 illustrates an embodiment of the invention employing a circular-shaped base 94. A column 96 is rotatably connected thereto similar to the FIG. 3 embodiment and is shown in FIG. 7 in its erect condition. Column 96 is of integral unitary construction but has two tiers which define stepped distal ends 98, 100.

Figure 8:
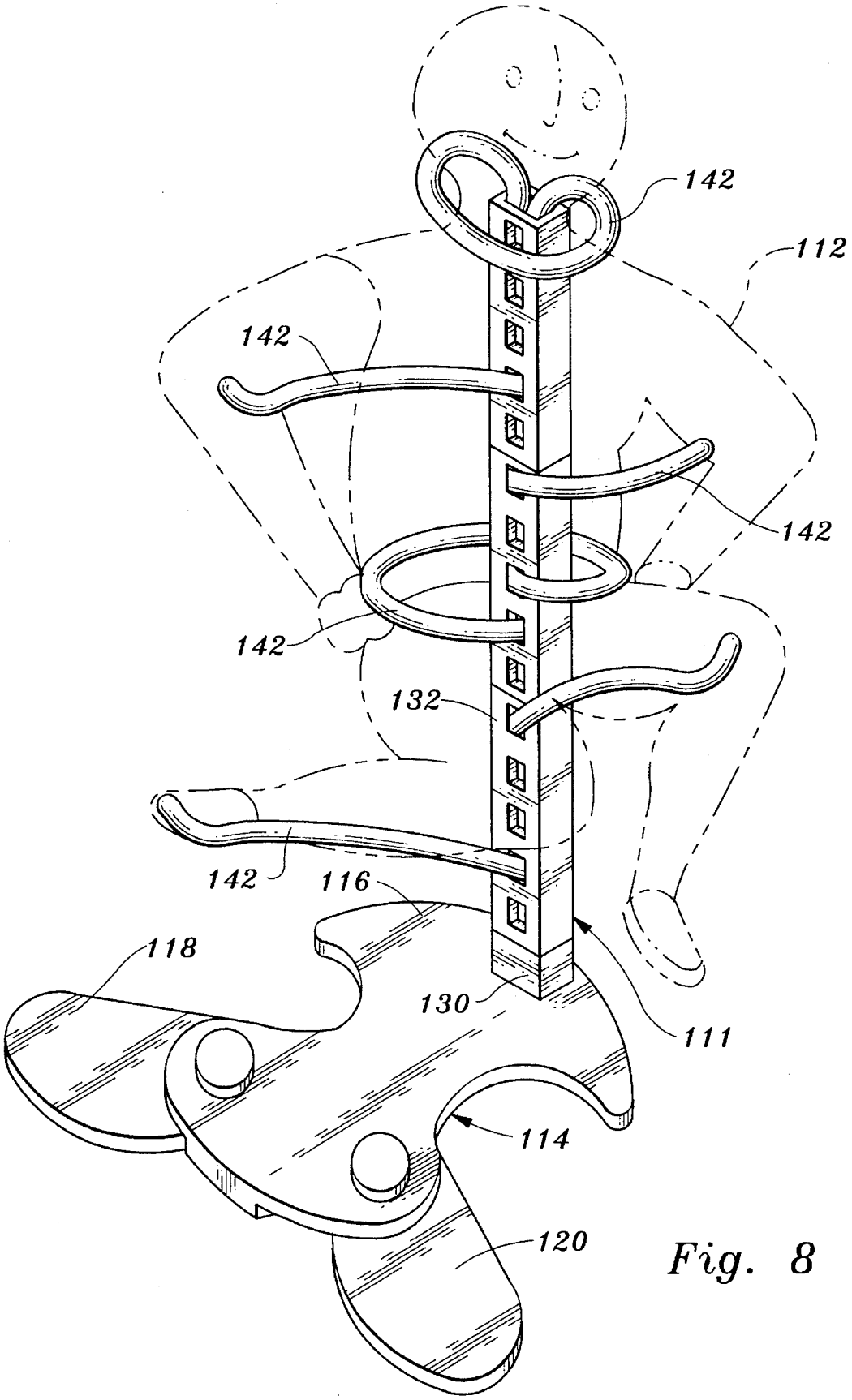
FIG. 8 is a perspective view of yet another embodiment.

FIGS. 8–17 disclose yet another embodiment of the invention. FIG. 8 illustrates this embodiment of the invention, designated by reference numeral 111 utilized to hold a doll 112 depicted by dash lines.

Apparatus 111 includes a base 114 including a central base member 116 and two supplemental base members 118 and 120. At one end thereof each of the supplemental base members has a hole 122. When assembling the base 114, holes 122 are placed under apertures 124 formed in the central base member 116. Then, a connector 126 acting as a pivot post is inserted through each aperture 124 and into a hole 122 of a supplemental base member to connect same together and allow pivoting thereof as illustrated in FIG. 13.

A socket 130 projects upwardly from an end of the central base member 116. The socket receives an end of a column element 132. More particularly, and with reference to FIG. 14 and 17, the socket 130 receives a reduced lower end of the column element 132 comprising spaced prongs 134. A plurality of column elements 132 may be stacked as shown in FIGS. 8, 14 and 17 to create a complete column of any desired length.

Each column element 132 has spaced, rectangular-shaped openings 140 therein. These openings receive elongated support elements 142, the user of the apparatus placing the elongated support elements 142 where desired depending upon the particular doll to be supported and the pose of the displayed doll.

Each elongated support element 142 is in the form of a wire of aluminum, steel or other suitable material covered by a protective layer of plastic 146 or other similar material. The dimensions and character of the elongated support elements are such that they may be readily bent by the user of the apparatus but sufficiently stiff to retain the configuration into which they are bent, until rebent by the user.

It should also be noted that end and/or ends of an elongated support element 142 may be inserted into the open top end of the column formed by the connected column elements. In FIGS. 8 and 17, both ends of an elongated support element are positioned in the open top most end of the top most column element and form a loop which may encircle the doll.

FIG. 17 illustrates yet another feature that may be employed in the embodiment of the invention under discussion. More particularly, an elongated support element holder or socket 150 may be positioned at a desired location along the length of the column and utilized to support one or a plurality of elongated support elements. FIG. 17 illustrates a holder in two alternate positions, one position wherein the holder is removed from the column and another position wherein the holder is mounted on the lowermost elongated support element 132. Connection is accomplished by means of detents 152 which are positioned in two adjacent openings 140 and pushed downwardly to temporarily lock into position.

It will thus be seen that in the embodiment of FIGS. 8–17, the doll engagement means actually comprises a portion of each of the elongated support elements 142 themselves. The actual doll engagement portion of each elongated support element is determined by where and how the elongated support elements are attached to the doll.

We claim:

1. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining a plurality of recesses at said column means distal end;

a plurality of elongated support elements selectively positionable in said plurality of recesses, said elongated support elements having attachment ends positionable in the plurality of recesses and outer ends spaced from said attachment ends; and doll engagement means connected to said elongated support elements for engaging a doll at spaced locations on said doll to support and display the doll when the attachment ends of said elongated support elements are positioned in said plurality of recesses at said column means distal end.

2. The apparatus according to claim 1 wherein said column means comprises at least two columns spaced from one another, each said column defining at least one recess at the distal end thereof.

3. The apparatus according to claim 1 wherein at least some of said elongated support elements differ in length.

4. The apparatus according to claim 1 additionally comprising base connector means for releasably connecting said base means to said column means.

5. The apparatus according to claim 1 wherein at least some of said elongated support elements are flexible.

6. The apparatus according to claim 1 wherein said base means, said column means, said plurality of elongated support elements, and said doll engagement means are all of molded plastic construction.

7. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining at least one recess at said column means distal end;

a plurality of elongated support elements selectively positionable in said at least one recess, each said elongated support element having an attachment end and an outer end spaced from said attachment end; and doll engagement means connected to said elongated support elements for engaging a doll at spaced locations on said doll to support and display the doll when the attachment ends of said elongated support elements are positioned in said at least one recess, said doll engagement means comprising at least one arm member connected to each of said elongated support elements at the outer end of the elongated support element, each said arm member projecting laterally from the elongated support element to which it is connected.

8. The apparatus according to claim 1 additionally comprising arm member connector means for connecting said at least one arm member to the outer end of an elongated support element and for preventing relative rotational movement between said at least one arm member and the elongated support element connected thereto.

9. The apparatus according to claim 7 wherein two arm members are connected to the outer end of each of said elongated support elements, said arm members being spaced from one another and curved to define a gap therebetween for accommodating a portion of a doll supported and displayed by said apparatus.

10. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining at least one recess at said column means distal end;

a plurality of elongated support elements selectively positionable in said at least one recess, each said elongated support element having an attachment end and an outer end spaced from said attachment end; and doll engagement means connected to said elongated support elements for engaging a doll at spaced locations on said doll to support and display the doll when the attachment ends of said elongated support elements are positioned in said at least one recess, said column means comprising a plurality of column elements and column connector means for axially releasably interconnecting said column elements in substantial alignment.

11. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining at least one recess at said column means distal end;

a plurality of elongated support elements selectively positionable in said at least one recess, each said elongated support element having an attachment end and an outer end spaced from said attachment end; and doll engagement means connected to said elongated support elements for engaging a doll at spaced locations on said doll to support and display the doll when the attachment ends of said elongated support elements are positioned in said at least one recess, said base means including at least two pivotally connected base members, said base members being selectively relatively pivotally movable between a first position wherein said base members diverge away from each other and a second position wherein said base members are in close proximity along substantial portions thereof.

12. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining at least one recess at said column means distal end;

a plurality of elongated support elements selectively positionable in said at least one recess, each said elongated support element having an attachment end and an outer end spaced from said attachment end; and doll engagement means connected to said elongated support elements for engaging a doll at spaced locations on said doll to support and display the doll when the attachment ends of said elongated support elements are positioned in said at least one recess, said apparatus additionally including securement means for securing said elongated support elements against rotation relative to said column means when the attachment ends of when said elongated support elements are positioned in said at least one recess, said securement means including elongated rib projecting into said at least one recess, said elongated support elements having a groove for receiving said elongated rib.

13. Apparatus for supporting and displaying a doll, said apparatus comprising, in combination:

base means for positioning on a support surface;

column means for connecting to said base means whereby said column means extends upwardly from said base means and is stabilized relative to said support surface by said base means, said column means having a column means distal end and defining a plurality of spaced recesses; and a plurality of elongated support elements selectively positionable in at least one selected recess, each said elongated support element having an attachment end and an outer end spaced from said attachment end and each including a portion for engaging a doll at a location on said doll to support and display the doll when the attachment ends of said elongated support elements are positioned in at least one of said recesses.

14. The apparatus according to claim 13 wherein said base means includes at least two pivotally connected base members, said base members being selectively relatively pivotally movable between a first position wherein said base members diverge away from each other and a second position wherein said base members are in close proximity along substantial portions thereof.

15. The apparatus according to claim 13 additionally comprising base connector means for releasably connecting said base means to said column means.

16. The apparatus according to claim 13 wherein said elongated support elements are flexible and can be manually bent into various shapes to accommodate different dolls and provide for different doll poses.

17. The apparatus according to claim 13 wherein said column means comprises a plurality of column elements axially releasably interconnected in substantial alignment.

* * * * *